US010077417B2

(12) United States Patent
Hasinovic et al.

(10) Patent No.: US 10,077,417 B2
(45) Date of Patent: Sep. 18, 2018

(54) CLEANING COMPOSITION COMPRISING AN ALKYL HYDROXYBUTYRATE AND METHOD OF CLEANING AIR INTAKE VALVE DEPOSITS

(71) Applicant: Ashland Licensing and Intellectual Property, LLC, Lexington, KY (US)

(72) Inventors: Hida Hasinovic, Lexington, KY (US); David E. Turcotte, Lexington, KY (US)

(73) Assignee: Ashland Licensing and Intellectual Property, LLC, Lexington, KY (US)

( * ) Notice: Subject to any disclaimer, the term of this patent is extended or adjusted under 35 U.S.C. 154(b) by 0 days.

(21) Appl. No.: 15/263,737

(22) Filed: Sep. 13, 2016

(65) Prior Publication Data

US 2017/0081621 A1 Mar. 23, 2017

Related U.S. Application Data

(60) Provisional application No. 62/220,273, filed on Sep. 18, 2015.

(51) Int. Cl.

| | |
|---|---|
| ***C11D 1/66*** | (2006.01) |
| ***C11D 3/32*** | (2006.01) |
| ***C11D 11/00*** | (2006.01) |
| ***B08B 3/08*** | (2006.01) |
| ***B08B 9/027*** | (2006.01) |
| ***C11D 3/43*** | (2006.01) |
| ***F02B 77/04*** | (2006.01) |
| ***F02M 35/10*** | (2006.01) |
| ***C11D 17/00*** | (2006.01) |
| *C11D 3/20* | (2006.01) |

(52) U.S. Cl.

CPC ..... *C11D 11/0041* (2013.01); *B08B 3/08* (2013.01); *B08B 9/027* (2013.01); *C11D 1/66* (2013.01); *C11D 3/43* (2013.01); *C11D 17/0021* (2013.01); *F02B 77/04* (2013.01); *F02M 35/10255* (2013.01); *C11D 3/2093* (2013.01); *C11D 3/32* (2013.01)

(58) Field of Classification Search

CPC ..... C11D 1/66; C11D 3/2093; C11D 3/32; C11D 11/0041; C11D 17/0021

See application file for complete search history.

(56) References Cited

U.S. PATENT DOCUMENTS

| | | | | |
|---|---|---|---|---|
| 5,407,453 | A * | 4/1995 | Pierce-Ruhland | C11D 3/2079 44/302 |
| 5,858,942 | A * | 1/1999 | Adams | B65D 83/756 123/1 A |
| 2003/0031964 | A1* | 2/2003 | Hayward | C11D 3/0084 431/3 |
| 2004/0103920 | A1* | 6/2004 | Gatzke | F02B 77/04 134/21 |
| 2008/0011327 | A1 | 1/2008 | Shriner et al. | |
| 2012/0071377 | A1* | 3/2012 | Huo | C11D 1/10 510/185 |
| 2015/0225676 | A1* | 8/2015 | De Wit | C11D 3/43 510/401 |
| 2017/0015898 | A1* | 1/2017 | Beach | C09K 8/035 |

FOREIGN PATENT DOCUMENTS

| | | | |
|---|---|---|---|
| FR | 2815639 | A1 | 4/2002 |
| WO | 0246588 | A1 | 6/2002 |
| WO | 2005091771 | A2 | 10/2005 |
| WO | 2006051255 | A1 | 5/2006 |
| WO | 2015017175 | A1 | 2/2015 |
| WO | 2015134163 | A1 | 9/2015 |

OTHER PUBLICATIONS

International Searching Authority, Search Report and Written Opinion issued in corresponding International Application No. PCT/US2016/051476 dated Jan. 7, 2017, 17 pages.

Santos, J., et al., "Development of eco-friendly emulsions produced by microfluidization technique," Journal of Industrial and Engineering Chemistry, Feb. 2016, pp. 90-95, vol. 36, Elsevier B.V. (6 pages).

* cited by examiner

*Primary Examiner* — Charles Boyer

(74) *Attorney, Agent, or Firm* — Wood Herron & Evans LLP

(57) ABSTRACT

A cleaning composition is particularly suited for cleaning dirty intake valves. The cleaning composition includes a high solvency surfactant/solvent which has a Kb greater than 100 or polar Hansen solubility parameter greater than 6. The surfactant/solvent is combined with a carrier such as water or an organic carrier and a surfactant. A wetting agent may also be employed. The cleaning composition is added to the intake air as a mist as the engine is running. Aqueous and non-aqueous versions are disclosed.

12 Claims, No Drawings

CLEANING COMPOSITION COMPRISING AN ALKYL HYDROXYBUTYRATE AND METHOD OF CLEANING AIR INTAKE VALVE DEPOSITS

RELATED APPLICATION

The present application claims priority to U.S. Ser. No. 62/220,273 filed Sep. 18, 2015, the disclosure of which is hereby incorporated herein by reference in its entirety.

BACKGROUND OF THE INVENTION

All direct injected engines, both gasoline and diesel, directly add fuel to the combustion chamber bypassing the intake valves for efficient combustion. Some of the exhaust and crankcase vapor gas is recirculated back to the air intake and over the intake valves. This can cause a buildup of a carbonaceous material on and around the manifold and air intake valves, which eventually decreases fuel efficiency and performance.

Some of this deposit can be removed by adding a cleaning composition into the air intake. Current cleaning compositions are generally organic solvent-based and therefore are suitable only for gasoline engines and are unsuitable for diesel engines. The fuel value of the solvents causes unintended increases in engine acceleration, sometimes resulting in damage from uncontrolled or run away combustion.

SUMMARY OF THE INVENTION

According to the present invention, a cleaning composition is used to clean intake valves of diesel engines by injecting the cleaning composition into the air intake of the engine as the engine is running. The cleaning composition dissolves and removes the oily carbonaceous buildup on the intake valves.

The cleaning composition uses a solvent/surfactant with no fuel value and water as a carrier, making it suitable for diesel engines as well as gasoline engines.

The same solvent/surfactant can be used with organic carriers for use only in gasoline engines.

DETAILED DESCRIPTION

The cleaning composition of the present invention includes a carrier, an organic solvent which has a high solvency and no fuel value, along with an appropriate surfactant and a wetting agent.

The carrier can be either water or an organic carrier/solvent. When the carrier is an organic carrier, the cleaning composition is only used for gasoline engines. If the carrier is water, the cleaning composition can be used in either diesel or gasoline engines. In all the formulations set out hereafter, the amount of carrier will form the balance of the formulation up to 100%. Generally, the carrier will comprise 0.1 to 98% by weight, generally 50-90% of the total composition The organic solvent also referred to as a surfactant/solvent used in the present invention must have a high solvency effective to dissolve oil, such as the oil in the carbonaceous buildup on the intake valves. Solvency can be defined by either the Kauri-butanol value or the Hansen solubility parameter. When defined by the Kb value, which is measured by ASTM D1133, the organic solvent should have a solvency of at least 100 and more typically 500, 1000 or higher than 1000. There are three different Hansen solubility parameters: the dispersive parameter; polar parameter and hydrogen bonding parameter. The polar parameter is more predictive of the ability of the solvent to dissolve oily compositions. Generally, the polar parameter should be at least 6, preferably 6.4 or higher, such as 9.5 or greater. Solvents with either the high Kb value or high polar Hansen solubility parameter can be used in the present invention.

The organic solvent should have no fuel value to make it suitable for use in a diesel engine. The carrier must not combust in the diesel engine. Thus, the pressure generated by the pistons of the diesel engine should not cause the organic solvent to combust.

One type of organic solvent suitable for the present invention is an alkyl substituted fatty amide such as an N,N dialkyl fatty acid amide, in particular, N,N-Dimethyl-9-decenamide. This organic solvent has a solvency greater than 1000 and also has the following Hansen solubility parameters: dispersive: 16.58, polar: 9.58 and hydrogen bonding: 8.45.

Other fatty acid amides and amide esters having a high solvency can be used. Many of these are disclosed in PCT application 2013/162926, the disclosure of which is incorporated herein by reference.

Another suitable organic solvent is an alkyl hydroxy butyrate. In particular, butyl-3-hydroxy butyrate. This organic solvent has a solvency greater than 100 and further has Hansen solubility parameters of dispersive: 16.13, polar: 6.541 and hydrogen bonding: 11.52. Generally the cleaning composition of the present invention will include 0.5 to 50% by weight of the organic solvent. More particularly, 2 to 20%, such as 2, 3, 4, 5, 6, 7, 8, 9, 10, 15 or 20%.

The aqueous-based cleaning composition will include a non-ionic surfactant. Any non-ionic surfactant which can form a micro emulsion between the carrier and the organic solvent can be utilized in the present invention. Typical non-ionic surfactants include the polyoxyethylene glycols, such as octaethylene glycol monododecyl ether or pentaethylene glycol monododecyl ether; polyoxypropylene glycol; glucoside alkyl ethers such as decyl glucoside, lauryl glucoside or octyl glucoside; polyoxyethylene glycol octylphenol ethers, such as TRITON X-100®; polyoxyethylene glycol alkylphenol ethers, such as nonoxynol-9; glycerol alkyl esters, such as glyceryl laurate; polyoxyethylene glycol sorbitan alkyl esters, such as polysorbate; sorbitan alkyl esters; cocamide MEA; cocamide DEA; dodecyldimethylamine oxide; block copolymers of polyethylene glycol and polypropylene glycol and polyethoxylated tallow amine, as well as many others. These non-ionic surfactants must be effective to produce micro emulsions of the carrier and the organic solvent. Generally, the cleaning composition will include from 0.5 to 5% by weight of the non-ionic surfactant.

Further, the composition of the present invention will include a wetting agent. Typical wetting agents include surface active agents (surfactants). One such wetting agent suitable for the present invention is Easy-Wet 20 from Ashland Inc. which is a blend of multiple nonionic surfactants; Undecyl Alcohol+EO Polyethoxylate, 1-Octyl-2-Pyrrolidone, 1-Undecanol and anionic surfactant, Sodium Lauryl Sulfate. Easy-Wet 20 significantly reduces surface tension at 0.02 weight % to less than 30 dynes/cm. This can be used in an amount from 0.1 to 20% by weight.

The present invention can also include a chelating agent such as iminodisuccinate sodium salt. If present, the chelating agent can form 0.1 to 20% by weight of the formulation. The chelating agent acts to bind metal ions present in the released grime. The formulation can further include a corrosion inhibitor to protect cleaned metal, generally present in an amount from about 0.1 to 10.0%. The present invention can further include a fragrance and biocide. Fragrance is present at whatever amount is desired, generally from 0.001 to 1.0% by weight and the biocide is generally present in an amount from 0.01 to 2.0%.

Preferably, the aqueous-based cleaning composition should have a basic pH generally in the range of 9-11 and in particular about 10.5. If necessary, a base, such as a sodium carbonate, can be added to alter the pH.

To form the cleaning composition of the present invention, the organic solvent is blended with the non-ionic surfactant and the corrosion inhibitor. Subsequently the water is introduced into the blend and the mixing is continued. As this mixing continues, the chelating agent, fragrance, biocide and finally the wetting agent are added in and mixing continued until a stable micro emulsion is formed.

The composition of the present invention can be used at any point in time during the life of the engine but typically will be utilized either after the engine has been used for a relatively long period of time, such as the time to go 100,000 miles in an automobile or truck, or when the gas mileage of an automobile or truck begins to decrease. Thus, it can be used on engines and vehicles that are experiencing reduced performance or simply periodically as preventive maintenance.

Generally, about 5 to about 100 ounces, or 20 to 40 ounces, of the cleaning composition will be introduced into the intake valve through the air induction system. Additional cleaning composition can be added if the deposits on the intake valves are particularly severe or if performance issues are confirmed by a borescope or OBD scan tool. The rate of injection should be approximately 3 gallons per hour.

The following formulation was tested:

| | WEIGHT (%) |
|---|---|
| 1. STEPOSOL MET-10U | 11.0 surfactant/solvent based on C-10/C-12 methyl ester |
| 2. BIOSOFT N91-6 | 9.0 nonionic surfactant (STEPAN) |
| 3. DeCORE APCI-95-MOD | 1.0 (corrosion inhibitor) |
| 4. Deionized water | 73.8 |
| 5. BAYPURE 100/34% | 4.0 iminodisuccinate sodium salt (chelating agent) |
| 6. LAVENDAR/LEMON ODORSYNTHESIS F-137710 | 0.1 Fragrance |
| 7. ONOXYDE 200 | 0.1 Biocide |
| 8. Easy-Wet 20 | 1.0 (wetting agent) Ashland Inc. |

The above formulation was tested on a direct injected diesel VW Golf with 118,000 miles. There were significant black deposits on the intake valves. As the car was running, the above formulation was injected into the intake. Four quarts were injected over the first twenty minutes, a fifth quart was injected at a rate of 3 gallons per hour and the final quart was injected at a rate of 3.5 gallons per hour. This resulted in clean intake valves, EGR valve and fuel rail.

Other suitable formulations containing high solvency, no fuel value solvents are listed below:

| Component | Weight (%) |
|---|---|
| Water DI | 84.0 |
| Sodium Carbonate Anhydrous | 2.0 |
| Baypure CX 100/34% | 2.0 |
| Eastman Omnia(TM) Solvent | 4.0 |
| Bio-soft N91-6 | 4.0 |
| Bio-terge PAS-85 Anionic Surfactant | 4.0 |

| Component | Weight (%) |
|---|---|
| Water DI | 79.0 |
| Sodium Carbonate Anhydrous | 2.0 |
| Baypure CX 100/34% | 2.0 |
| Eastman Omnia(TM) Solvent | 4.0 |
| Tomadol 902 Surfactant Nonionic Surfactant | 4.0 |
| Tomakleen G-12 Additive Solvent Replacement Additive | 4.0 |
| Bio-terge PAS-85 | 5.0 |

| Component | Weight (%) |
|---|---|
| Water DI | 84.9 |
| Bio-soft N91-6 | 5.0 |
| Steposol MET-10U | 5.0 |
| Easy-Wet 20 (ACO-5037) | 5.0 |
| Surcide ICP Biocide | 0.1 |

| Component | Weight (%) |
|---|---|
| Water DI | 84.8 |
| Steposol MET-10U | 5.0 |
| Tomadol 900 Nonionic Surfactant | 5.0 |
| Easy-Wet 20 | 5.0 |
| Surcide ICP | 0.2 |

| Component | Weight (%) |
|---|---|
| Water DI | 74.0 |
| Omnia TM Solvent | 10.0 |
| Bio-soft N91-6 | 6.0 |
| Bio-terge PAS 85 | 6.0 |
| Baypure CX 34% | 4.0 |

| Component | Weight (%) |
|---|---|
| Water DI | 76.0 |
| Omnia TM Solvent | 10.0 |
| Vitech Q3 (Nonionic/Cationic Blend) | 4.0 |
| Bio-terge PAS 85 | 6.0 |
| Baypure CX 34% | 4.0 |

| Component | Weight (%) |
|---|---|
| Water DI | 73.0 |
| Sorez HS-205 Vinylpyrrolidone/ Dimethylaminoethyl Methacrylate Copolymer | 1.0 |
| Bio-soft N91-6 | 6.0 |
| Bio-terge PAS 85 | 6.0 |
| Omnia TM Solvent | 10.0 |
| Baypure CX 34% | 4.0 |

| Component | Weight (%) |
|---|---|
| Water DI | 85.0 |
| Omnia TM | 5.0 |
| Vitech Q3 | 4.0 |
| Bio-terge PAS-85 | 6.0 |

| Component | Weight (%) |
|---|---|
| Water DI | 87.5 |
| Steposol MET-10U | 2.5 |
| Vitech Q3 | 4.0 |
| Bio-terge PAS-85 | 6.0 |

| Component | Weight (%) |
|---|---|
| Steposol MET | 5.0 |
| Tomadol 900 | 5.0 |
| Water | 82.8 |
| Easy-Wet 20 | 5.0 |
| Stepanol WA-Extra Pck Anionic Surfactant | 2.0 |
| Surcide ICP | 0.2 |

| Component | Weight (%) |
|---|---|
| Steposol MET | 5.0 |
| Tomadol 900 | 5.0 |
| Water DI | 88.0 |
| Easy-Wet 20 | 1.0 (+1 g) |
| Stepanol WA-Extra Pck | 1.0 (+1 g) |

| Component | Weight (%) |
|---|---|
| Steposol MET-10U | 2.0 |
| Surfacdone LP 100 N-Octyl-2-Pyrrolidone | 2.0 |
| Vitech Q3 | 3.0 |
| Water DI | 92.0 |
| Easy-Wet 20 | 1.0 |

| Component | Weight (%) |
|---|---|
| Steposol MET-10U | 2.0 |
| Tomadol 902 Surfactant | 2.0 |
| Vitech Q3 | 3.0 |
| Water DI | 92.0 |
| Easy-Wet 20 | 1.0 |

| Component | Weight (%) |
|---|---|
| Steposol MET-10U | 8.0 |
| Vitech Q3 | 4.0 |
| Bio-terge PAS-85 | 6.0 |
| Water DI | 82.0 |

| Component | Weight (%) |
|---|---|
| Steposol MET-10U | 5.0 |
| Vitech Q3 | 4.0 |
| Bio-terge PAS-85 | 6.0 |
| Water DI | 85.0 |

| Component | Weight (#) |
|---|---|
| Steposol MET-10U | 5.0 |
| Vitech Q3 | 7.0 |
| Water DI | 88.0 |

| Component | Weight (#) |
|---|---|
| Steposol MET-10U | 7.0 |
| Vitech Q3 | 7.0 |
| Water DI | 86.0 |

| Component | Weight (%) |
|---|---|
| Steposol MET-10U | 5.0 |
| Vitech Q3 | 7.0 |
| Fragrance | 0.1 |
| Water DI | 87.8 |
| Biocide | 0.1 |

| Component | Weight (%) |
|---|---|
| Steposol MET-10U | 10.0 |
| Bio-soft N91-6 | 10.0 |
| Water | 74.8 |
| Trilon M Chelating Agent | 3.0 |
| Easy-Wet 20 | 2.0 |
| Lavender Lemon Odor synthesis | 0.1 |
| Kathon CG-ICP/Onoxide Biocides | 0.1 |

| Component | Weight (%) |
|---|---|
| Steposol MET-10U | 10.0 |
| Berol 609 Nonionic Surfactant | 10.0 |
| Blend Water | 72.8 |
| Easy-Wet 20 | 2.5 (1.5) |
| Trilon M/Baypure CX 100/34% Chelating Agents | 4.5 |
| Fragrance | 0.1 |
| Biocide | 0.1 |

| Component | Weight (%) |
|---|---|
| Steposol MET-10U | 10.0 |
| Berol 226 SA | 10.0 |
| Water | 67.0 |
| Easy-Wet 20 | 2.0 |
| Trilon M | 5.0 |
| Tomalkeen G-12 Additive | 6.0 |

| Component | Weight (%) |
|---|---|
| EB Glycol Ether EB | 10.0 |
| TEA 85% Triethanol Amine | 5.0 |
| EDTA/Baypure | 5.0 |
| Water | 80.0 |

| Component | Weight (%) |
|---|---|
| Steposol MET-10U | 10.0 |
| Berol 609 | 6.0 |
| Berol 226 SA Cationic/ Nonionic Blend | 6.0 |
| Water | 78.0 |

| Component | Weight (%) |
|---|---|
| Water | 86.0 |
| Tomakleen G-12 | 6.0 |
| Baypure CX 100/34% | 4.0 |
| DeTeric CP Amphoteric Surfactant | 4.0 |

| Component | Weight (%) |
|---|---|
| Steposol MET-10U | 9.0 |
| DeTeric CP | 6.0 |
| Berol 609 | 6.0 |
| Water | 70.0 |
| Baypure | 3.5 |
| Tomakleen | 2.0 |
| Berol 226 SA | 3.5 |

| Component | Weight (%) |
|---|---|
| DeCore APCI-95 MOD Corrosion Inhibitor | 1.0 |
| Steposol MET-10U | 11.0 |
| Bio-soft N91-6 | 9.0 |
| Water DI | 73.8 |
| Easy-Wet 20/Surfadone LP-100 | 1.0 |
| Baypure CX 100/34% | 4.0 |
| Lavender Lemon F-137710 | 0.1 |
| Onyxide 200 | 0.1 |

A non-aqueous organic carrier-based system can also be used but only for gasoline engines. Such a formulation will include the high solvency organic solvent discussed above, generally from 1.0 weight % to about 90%, generally 2-20% by weight. In addition, this will have an organic carrier as well as a surfactant which combine to form a stable solution. Nonionic, cationic and anionic surfactants are added to the carrier for emulsification of those challenging cleaning deposits, and wetting agents are added for better spreadability. Corrosion inhibitors can be added for cleaned metal surfaces protection. One particular carrier suitable for use in the present invention is n-propyl propionate, which is a flammable carrier. Other suitable carriers include pentyl propionate, n-butyl propionate, isobutyl isopropionate and glycol ether EB. This will form the balance of the formulation up to 100%. Generally the carrier will be 1 weight % to about 99 weight % of the present invention.

In addition to the carrier and the organic solvent, the present invention will include a surfactant or surfactant blend which is effective to maintain a stable solution. The surfactants can be any of the non-ionic surfactants previously listed. A blend of cationic and nonionic surfactants can be used. One such surfactant blend is Berol 226SA form Akzo Nobel Surface Chemistry LLC. This surfactant is blend of nonionic surfactant Ethoxylated Alcohol and Cationic Quaternary Amine Compound. Generally the surfactant will be 0.1 weight % to about 50 weight % of the cleaning composition. The surfactant blend above generally supports wetting, however wetting agents can be added separately to support better spreading and better cleaning and will be used from 0.1 weight % to about 20 weight %, typically about 1.0%. Finally, fragrance will be used at concentration level from 0.01 to 2.0 weight %, typically 0.1 weight %.

The organic solvent carrier formulation is formed by simply combining the high solvency organic solvent along with the organic solvent carrier and the surfactant system. This is mixed together and, while being blended, a wetting agent as well as the fragrance and any other desired components, such as a chelating agent, can be added. This composition, due to the solvency of the organic solvent, again can be added to the induction air intake system of a gasoline engine as previously described to effectively remove buildup at the air intake valves. The rate of administration of the cleaning composition, as well as the overall amount, will be approximately the same as the aqueous-based formulation.

Accordingly, the present invention provides cleaning compositions and methods of using the cleaning compositions to remove carbonaceous oily buildup on air intake valves of either diesel or gasoline engines. This will effectively increase the life of the engine and provide improved overall performance.

This has been a description of the present invention along with the method of practicing the present invention. However, the invention should be defined by the appended claims wherein we claim:

What is claimed is:

1. A method of cleaning an air intake valve of an engine comprising:

introducing a cleaning composition into the air intake of an engine as said engine is running;

said cleaning composition comprising:

a micro-emulsion including an alkyl hydroxybutyrate having a Hansen solubility parameter greater than 6 and a fuel value sufficiently low that it does not combust in a diesel engine and having a solvency effective to dissolve buildup on said valves;

water; and a surfactant effective to establish a micro emulsion of said alkyl hydroxybutyrate and said water.

2. The method claimed in claim 1 wherein said surfactant is a nonionic surfactant.

3. The method claimed in claim 2 wherein said cleaning composition further includes a wetting agent.

4. The method claimed in claim 1 wherein said alkyl hydroxybutyrate has a Kb greater than 100.

5. The method claimed in claim 1 wherein said alkyl hydroxybutyrate has a Kb greater than 500.

6. The method claimed in claim 1 wherein said alkyl hydroxybutyrate has a Kb greater than 1000.

7. A method of cleaning an air intake valve of an engine comprising:

introducing a cleaning composition into the air intake of an engine as said engine is running;

said cleaning composition comprising:

a micro-emulsion including an alkyl hydroxybutyrate having a Hansen solubility parameter greater than 6 and a fuel value sufficiently low that it does not combust in a diesel engine and having a solvency effective to dissolve buildup on said valves;

water; and a surfactant effective to establish a micro emulsion of said alkyl hydroxybutyrate and said water, wherein said alkyl hydroxybutyrate is butyl 3-hydroxybutyrate.

8. The method claimed in claim 7 wherein said surfactant is a nonionic surfactant.

9. The method claimed in claim 8 wherein said cleaning composition further includes a wetting agent.

10. The method claimed in claim 7 wherein said butyl 3-hydroxybutyrate has a Kb greater than 100.

11. The method claimed in claim 7 wherein said butyl 3-hydroxybutyrate has a Kb greater than 500.

12. The method claimed in claim 7 wherein said butyl 3-hydroxybutyrate has a Kb greater than 1000.

* * * * *